US006308765B1

(12) United States Patent
Grinberg et al.

(10) Patent No.: US 6,308,765 B1
(45) Date of Patent: Oct. 30, 2001

(54) METHOD OF MAKING TOOLS HAVING A CORE DIE AND A CAVITY DIE

(76) Inventors: Grigoriy Grinberg, 4758 Mount Airy, Sylvania, OH (US) 43560; David Robert Collins, 14903 Forest, Southgate, MI (US) 48195; Jeffrey Alan Kinane, 410 Catalpa, Birmingham, MI (US) 48009; Paul Earl Pergande, 20750 Smallwood Ct., Beverly Hills, MI (US) 48025

( * ) Notice: Subject to any disclaimer, the term of this patent is extended or adjusted under 35 U.S.C. 154(b) by 0 days.

(21) Appl. No.: 09/185,762

(22) Filed: Nov. 4, 1998

(51) Int. Cl.[7] ..... B22C 9/04; B22D 23/00
(52) U.S. Cl. ..... 164/34; 164/45; 164/46
(58) Field of Search ..... 164/46, 34, 45

(56) References Cited

U.S. PATENT DOCUMENTS

| | | | |
|---|---|---|---|
| 4,549,597 | 10/1985 | Hamamura . | |
| 5,189,781 * | 3/1993 | Weiss et al. | 164/19 |
| 5,460,851 | 10/1995 | Jenkins et al. . | |
| 5,476,222 | 12/1995 | Singer et al. . | |
| 5,516,586 | 5/1996 | Singer et al. . | |
| 5,634,593 | 6/1997 | Jenkins . | |
| 5,635,096 | 6/1997 | Singer et al. . | |
| 5,658,506 | 8/1997 | White et al. . | |
| 5,718,863 | 2/1998 | McHugh et al. . | |
| 5,746,966 | 5/1998 | McDonald . | |

FOREIGN PATENT DOCUMENTS

| | | |
|---|---|---|
| 2338666 | 12/1999 | (GB) . |
| WO 96/09421 | 3/1996 | (WO) . |

* cited by examiner

*Primary Examiner*—Kuang Y. Lin

(57) ABSTRACT

The present invention relates to a method of making a molding tool comprising a core die and a cavity die. The method comprises (a) providing a first metal deposit comprising one of the cavity die or the core die, the first metal deposit having a die face, (b) providing a spray forming pattern on a portion of the die face of the first metal deposit,(c) spraying metal particles onto the first metal deposit and the spray forming pattern to form a second metal deposit comprising the other of the cavity die or the core die, and (d) removing the spray forming pattern from the first and second metal deposits.

20 Claims, 3 Drawing Sheets

METHOD OF MAKING TOOLS HAVING A CORE DIE AND A CAVITY DIE

TECHNICAL FIELD

The present invention relates to the making of tools, and more particularly to a method of making stamping or molding tools having a smooth interface between two parts of the molding tool.

BACKGROUND ART

Tools, such as injection molding tools, typically comprise a core die and a cavity die. Each die has a die face having a parting surface and a mold cavity defining surface. The dies are capable of relative movement between a first position, wherein the parting surfaces abut each other to form an interface, and a second position, wherein the die faces are spaced from each other. The mold cavity defining surfaces, when the dies are in the first position, provide a mold cavity for forming an injection molded part. When the dies are in the second position, the relative positioning of the dies allows for removal of the formed part.

The dies are typically metal deposits manufactured by spray forming. Each metal deposit is formed independent of each other by spray depositing metal on a respective spray forming pattern. After removal from the spray forming pattern, the parting surface of each deposit undergoes "spotting" to form perfectly matched parting surfaces to achieve a smooth, acceptable interface. Spotting is a relatively tedious and time consuming process that involves grinding and machining operations to remove high contact spots from the parting surfaces. As such, spotting accounts for a relatively large portion of the time and monetary expenditure in making tools.

Accordingly, it is an object of the present invention to provide a less time consuming and more economical method for making tools. It is another object of the present invention to provide a method of making metal deposits for tools without having to spot each of the deposits.

DISCLOSURE OF INVENTION

The present invention meets the above, and other, objects by providing a method of making a molding tool comprising a core die and a cavity die. The method comprises (a) providing a first metal deposit comprising one of the cavity die or the core die, the first metal deposit having a die face, (b) providing a spray forming pattern on a portion of the die face of the first metal deposit, (c) spraying metal particles onto the first metal deposit and the spray forming pattern to form a second metal deposit comprising the other of the cavity die or the core die, and (d) removing the spray forming pattern from the first and second deposit.

DETAILED DESCRIPTION AND BEST MODE

The present invention relates to a method of making tools comprising a first tool part, such as a core die, and a second tool part, such as a cavity die. The present invention can be employed to make any tools which are usable for forming molded or stamped die cast parts. The method of the present invention is particularly well suited for forming injection molding tools, and as such, will be described herein for forming an injected molded tool, but in doing so, is not intended to be limiting in any way.

Figure 2:
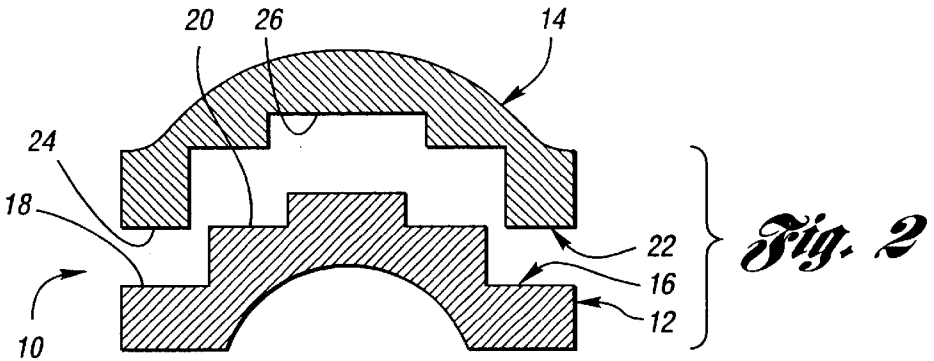
FIG. 2 illustrates the tool of FIG. 1 in a different position.
Figure 1:
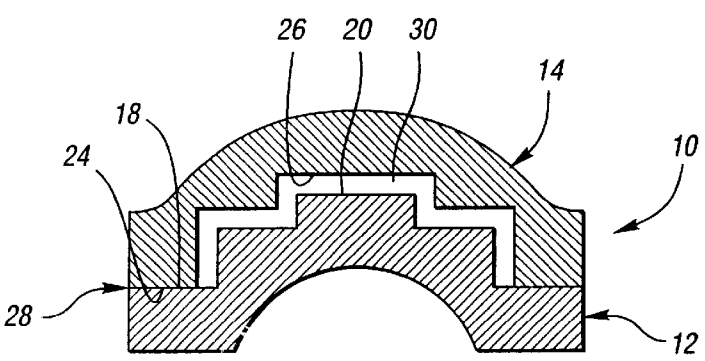
FIG. 1 is a schematic illustration of a tool formed by the method of the present invention.

An exemplary injection molded tool 10 is shown schematically in FIGS. 1 and 2. The tool 10 comprises a core die 12 and a cavity die 14. The core die 12 has a die face 16 facing the cavity die 14. The die face 16 of the core die 12 has a generally planar parting surface 18 and a cavity defining surface 20 having the general shape of one of the surfaces of the part to be formed. The cavity die 14 has a die face 22 facing the core die 12. The die face 22 of the cavity die 14 has a generally planar parting surface 24 and a core defining surface 26 having the general shape of another of the surfaces of the part to be formed.

The core die 12 and the cavity die 14 are capable of relative movement between a first position, as shown in FIG. 1, and a second position shown in FIG. 2. When in the first position, the dies 12 and 14 abut each other to form an interface 28, formed by the abutment of the mating surface 18 of the core die 12 with the mating surface 24 of the cavity die 14. A mold cavity 30 defined by the cavity forming surfaces 20 and 26 of the core die 12 and the cavity die 14, respectively is also formed when the dies 12 and 14 are in the first position. The mold cavity 30 has the general shape of the part to be formed by the tool 10. When in the second position, as shown in FIG. 2, the dies 12 and 14 are spaced relative from each other to allow for removal of a formed part.

The method of the present invention comprises providing a first metal deposit. The first metal deposit can comprise either one of the cavity die or the core die. As preferably shown in FIG. 3, the first metal deposit comprises the core die 12 in the tool. The first metal deposit 12 can be made in any manner known in the art. A particularly preferred manner of making the first metal deposit 12 is spray forming.

After the first metal deposit 12 has been provided, a spray forming pattern 32 is then provided on a portion of the die face 16 of the first metal deposit 12. The spray forming pattern 32 has the general shape of the part, or a portion of the part, to be formed by the tool 10 and is essentially defined by an upper surface 34 and a base surface 36.

The base surface 36 of the spray forming pattern 32 has the general shape of the cavity defining surface 20 of the die face 16 of the first metal deposit 12 such that the base surface 36 of the spray forming pattern 32 fittingly engages the cavity defining surface 20 of the die face 16 of the first metal deposit 12 when the spray forming pattern 32 is positioned on the first metal deposit 12. The majority of the first parting surface 18 of the die face 16 of the first metal deposit 12 is not covered by the spray forming pattern 32 when the spray forming pattern is positioned on the first metal deposit 12.

The upper surface 34 of the spray forming pattern 32 has the general shape of the cavity defining surface 26 of the die face 22 of the cavity die, or second metal deposit 14, such that the cavity defining surface 26 of the second metal deposit 14 fittingly engages the upper surface 34 of the spray forming pattern 32 when the second metal deposit 14 is positioned on the spray forming pattern. The parting surface 24 of the die face 22 of the second metal deposit 14 abuts the portion of the parting surface 18 of the die face 16 of the first metal deposit 12, which is not covered by the pattern 32, when the second metal deposit 14 is positioned on the spray forming pattern 32.

The spray forming pattern 32 can be made of any suitable material capable of withstanding appreciable degradation from the heat associated with the spraying step in step (c). Examples of suitable materials include, but are not limited to, high heat resistant materials, such as ceramic; metals, such as a low melting point temperature alloys; and polymeric materials.

The spray forming pattern 32 can be prepared remotely from the first metal deposit 12 and then later positioned on the first metal deposit or the spray forming pattern 32 is prepared directly on the first metal deposit 12.

Any suitable manner can be employed for remotely forming the spray forming pattern 32 from the first metal deposit 12. One suitable manner includes injecting the spray forming pattern material into a mold that is created by two masters to form the spray forming pattern 32.

Figure 4:
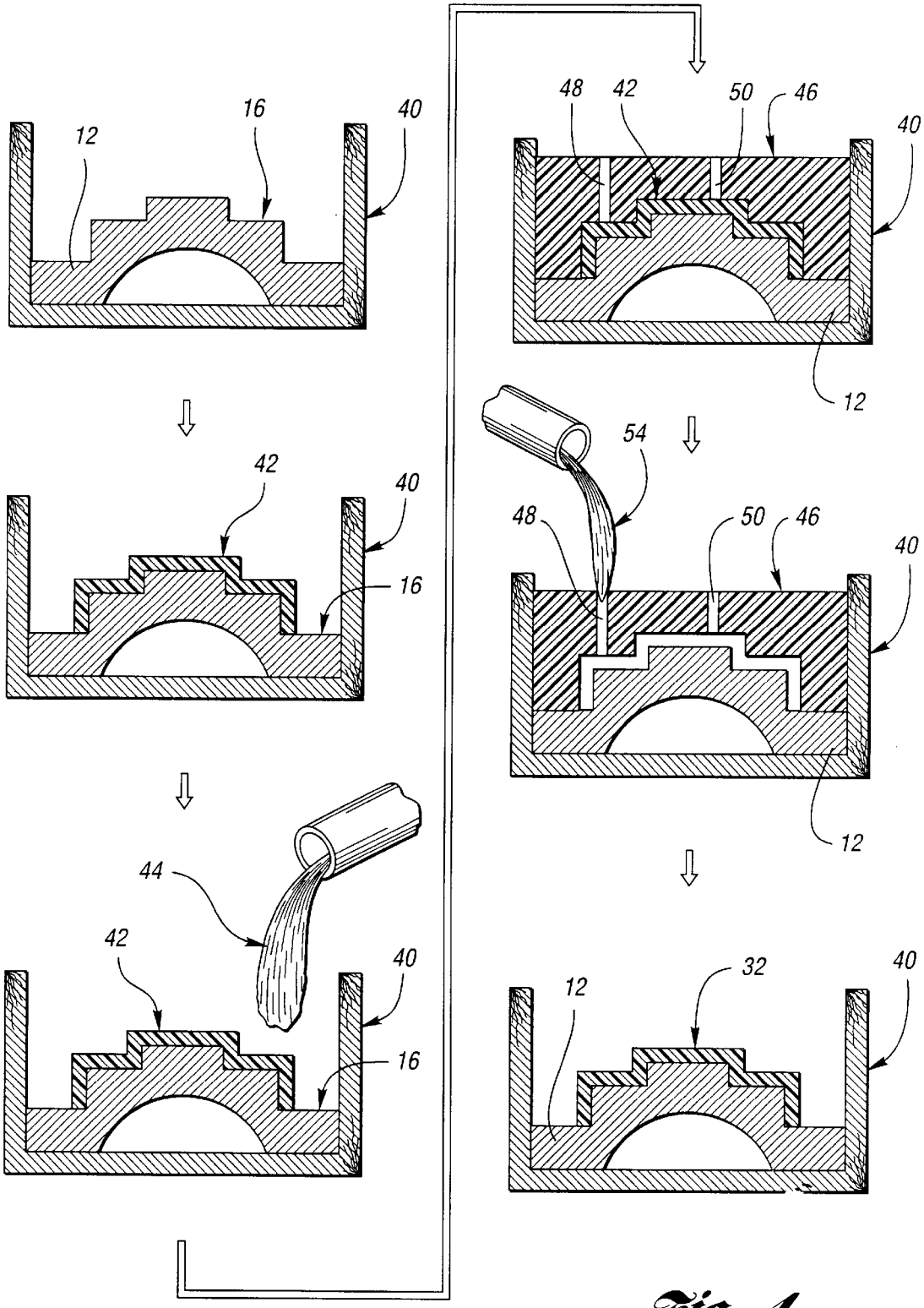
FIG. 4 is a schematic flow diagram of a preferred embodiment of one of the steps of FIG. 3.

A preferred method for preparing the spray forming pattern 32 directly on the first metal deposit 12 is shown in FIG. 4. The first metal deposit 12 is positioned in an open box 40 (laminated wood) with the die face 16 facing upward. A rapid prototype master 42, having the general shape of the spray forming pattern 32, is then positioned on the die face 16 of the first metal deposit 12. The prototype master 42 is formed of any suitable material, such as metal, wood, polymeric, renboard, laminate materials, etc.

A liquid casting mold material 44 is then poured into the box 40 about the first metal deposit 12 and the prototype master 42 to form a casting mold 46. A pour channel 48 and a vent 50 are formed in the casting mold 46 by any conventional means, and are preferably formed by drilling down to the prototype master 42. The pour channel 48 and the vent 50 could alternatively be cast in place. The casting mold 46 is made of any suitable material which can (i) form a relatively durable article when solidified, and (ii) withstand the temperature of the liquid spray forming pattern material without degradation of melting, as will be explained below further. Examples of suitable materials include, but are not limited to, silicone, epoxides, polyurethanes, polyacrylates, and unsaturated polyesters, with silicone being preferred. The casting mold 46 could also be milled, or otherwise formed, out of metal, wood, renboard, laminate materials, etc.

The prototype master 42 is then removed from the first metal deposit 12 and the casting mold 46, with the casting mold being placed back on the first metal deposit. Preferably, a release agent, such as silicone or wax, is previously applied to the prototype master 42 to facilitate this step. With the prototype master 42 removed, the casting mold 46 cooperates with the first metal deposit 12 to form a molding cavity 52 having the general shape of the spray forming pattern 32.

Liquified spray forming pattern material 54 is then poured into the pour channel 48 to fill the molding cavity 52. As discussed above, the casting mold 46 must be able to withstand the temperature of the liquified spray forming material to prevent degradation or melting of the casting mold 46 during the casting of the spray forming pattern 32. After the spray forming pattern material 54 solidifies to form the spray forming pattern 32, any excess solidified material on the spray forming pattern 32, formed by way of the spray forming material 54 solidifying in the pour channel 48 or vent 50, can be removed, preferably by being cut away, from the spray forming pattern 32 to attain the desired shape of the spray forming pattern. The first metal deposit 12, with the spray forming pattern 32 positioned thereon, is then removed from the box 40 and are ready for use as a receptor for metal spray forming the second metal deposit 14.

Figure 3:
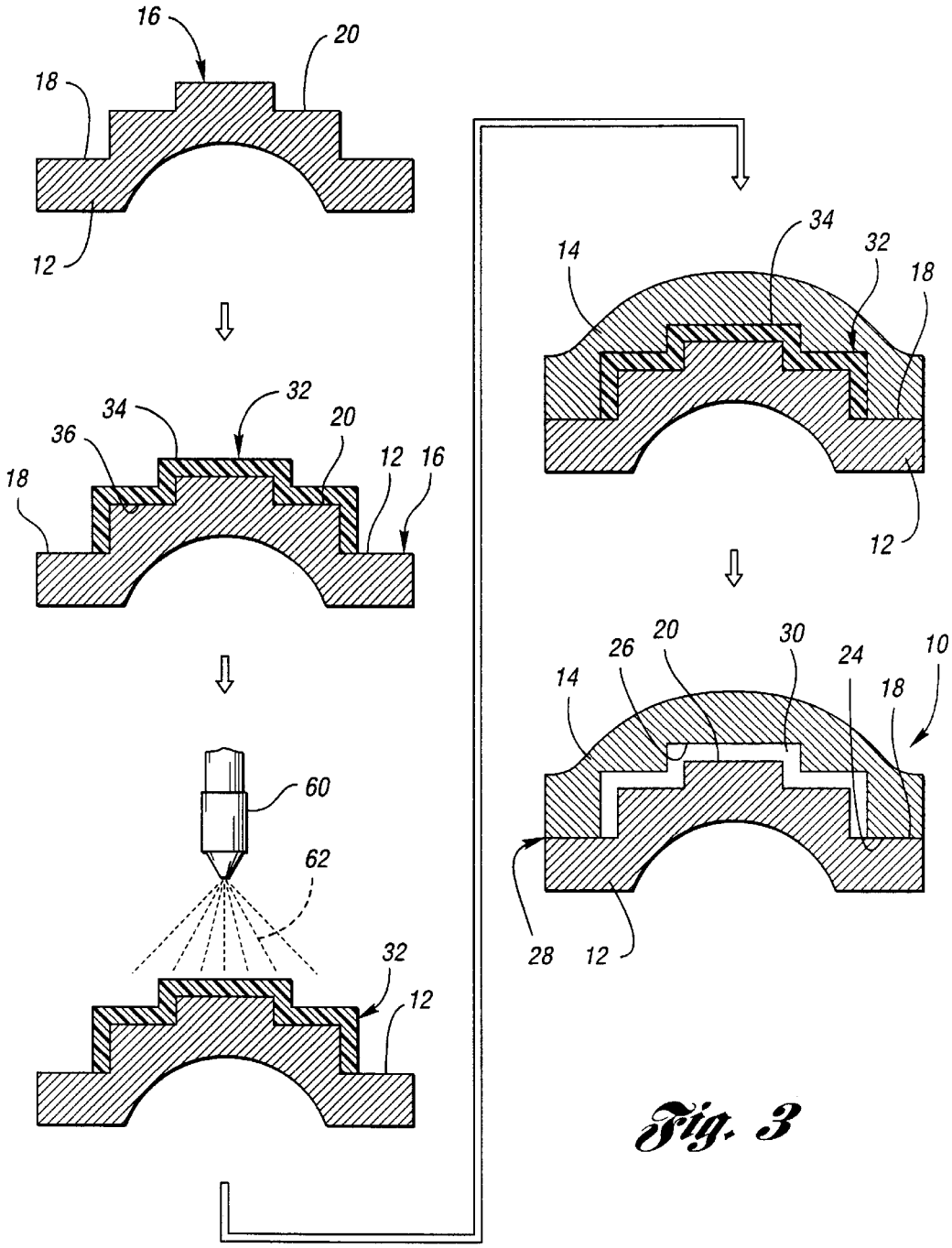
FIG. 3 is a schematic flow diagram of the processing steps of the present invention.

Thermal spray guns 60, shown schematically in FIG. 3, are utilized to spray metallic particles 62 onto the spray forming pattern 32 and the first metal deposit 12. Specifically, the spray guns 60 deposit metallic particles 62 onto the upper surface 34 of the spray forming pattern 32 and the majority of parting surface 18 of the die face 16 of the first metal deposit 12.

The thermal spray guns 60 may be of the oxy-acetylene flame type in which a wire or powder metal is fed thereinto, a plasma into which powder metal is fed, or preferably one or two wire arc type, in which the tip of the wires is fed into the arc. Cold spraying guns could be used in place of thermal spraying guns 60 to spray metallic particles 62 onto the spray forming pattern 32 and the first metal deposit 12.

In a two wire arc spray gun, an electric arc is generated in a zone between two consumable wire electrodes; as the electrodes melt, the arc is maintained by continuously feeding the electrodes into the arc zone. The metal at the electrode tips is atomized by a blast of generally cold compressed gas. The atomized metal is then propelled by the gas jet to a substrate forming a deposit thereon.

In a single wire arc apparatus, a single wire is fed either through the central axis of the torch or is fed at an acute angle into a plasma stream that is generated internally within the torch. The single wire acts as a consumable electrode that is fed into the arc chamber. The arc is established between the cathode of the plasma torch and the single wire as an anode, thereby melting the tip of the wire. Gas is fed into the arc chamber, coaxially to the cathode, where it is expanded by the electric arc to cause a highly heated gas stream (carrying metal droplets from the electrode tip) to flow through the nozzle. A further higher temperature gas flow may be used to shroud or surround the spray of molten metal so that droplets are subjected to further atomization and acceleration.

Yet still other wire arc torch guns may be utilized that use a transferred-arc plasma whereby an initial arc is struck between a cathode and a nozzle surrounding the cathode; the plasma created from such arc is transferred to a secondary anode (outside the gun nozzle) in the form of a single or double wire feedstock causing melting of the tip of such wire feedstock.

Preferably, three thermal spray guns are utilized to lay down the metal particles 62 on the spray forming pattern 32 and the first metal deposit 12. Each of the guns have a gun tip which is spaced relative to the other gun tips and is oriented toward the spray forming pattern 32 and the first metal deposit 12. Each tip being arranged generally about 7 to 15 inches from the spray forming pattern 32 and the first metal deposit 12. Each of the spray guns preferably have a power supply operated at a voltage of about 30 and a current supply of between about 100–250 amperes.

Each of the guns is supplied with a high pressure gas from their respective supplies consisting of nitrogen, air, or a mixture thereof, at a pressure of about 40 to 120 psi.; such gas being utilized to affect the atomization of the wire droplets.

The guns may preferably be moved robotically and the spray forming pattern 32 and first metal deposit 12 may be mounted on a turntable (not shown) and rotated by a motor to achieve relative movement between the spray pattern of the guns and the spray forming pattern 32 and the first metal deposit 12; repeated passes of the spray material will deposit the cavity die, or the second metal deposit 14 on the spray forming pattern 32 and the first metal deposit 12.

The thermal spraying step preferably lasts for about three hours, and results in the second metal deposit 14 having a thickness of at least about 0.5 inches, and preferably between about 1.5 to about 2.0 inches, on the spray forming pattern 32 and the first metal deposit 12. The thermal spraying step can of course vary depending upon the size of the deposit 14 to be formed.

The type of spray forming pattern material 54 used to form the spray forming pattern 32 may affect the selection of the operating parameters for the spraying of metal particles. For instance, when the spray forming pattern 32 is metal, or polymeric, it is important that the surface temperature of the spray forming pattern 32 be preferably less than the melting point temperature of the metal used to form the pattern 32 or the glass transition temperature of the polymeric material, however the case may be, so that the spray forming pattern 32 does not undergo any appreciable melting or degradation.

The wire feedstock utilized for each of the guns to form the metal particles 62 preferably has a chemistry that consists of steel with carbon in the range of 0.01 to 0.9 by weight. Materials other than steel could alternatively be employed to form the metal particles 62.

After the second metal deposit 14 has been formed, the spray forming pattern 32 is then removed from the first and second metal deposits 12 and 14. The method of removal may vary depending upon the type of spray forming pattern material 54 used.

Figure 5:
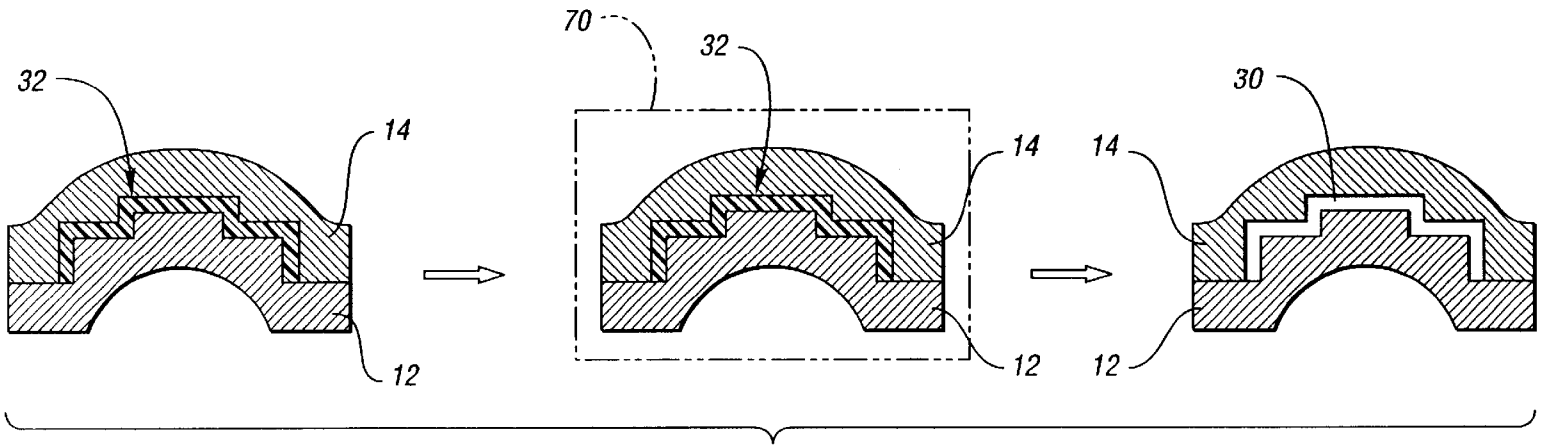
FIG. 5 is a schematic flow diagram of a preferred embodiment of one of the steps of FIG. 3.

If the spray forming pattern 32 is made of metal or polymer, this can be done, as shown in FIG. 5, by heating the first metal deposit 12, the second metal deposit 14, and the spray forming pattern 32, preferably in an oven 70, to a temperature which is sufficient to melt the spray forming pattern 32, but which is not sufficient to degrade or melt the first and second metal deposits 12 and 14. Before this heating step, holes can be drilled into the deposits 12 and 14 to help relieve pressure which may build up during the heating step. A suitable temperature will vary depending upon the specific spray forming pattern material 54 employed. In a particularly preferred embodiment, a liquified tin-bismuth alloy, preferably METSPEC-281 from MCP of Fairfield, Conn., having a melting point temperature of about 138.5° C., is employed as the spray forming pattern material 54, in which case, the suitable temperature would be between about 140° C. and 800° C., and preferably between 200° C. and 500° C. Removal of the pattern 32, results in the molding cavity 30 being formed between the first and second metal deposit 12 and 14 in the space previously occupied by the spray forming pattern 32. The resulting molding cavity 32 has the general shape of the spray forming pattern 32, or the part to be formed. The first and second metal deposits 12 and 14 can then be relatively easily separated for use in a molding tool.

If the spray forming pattern 32 is formed of ceramic, the spray forming pattern can be removed by first separating the first and second metal deposits 12 and 14 from each other, preferably with the use of a chisel. The ceramic spray forming pattern 32 can then be removed from the first and second metal deposits 12 and 14, preferably with the use of the bead blaster.

Regardless of the manner of removing the spray forming pattern 32, because the second metal deposit 14 is formed directly on the first metal deposit 12, the resulting parting surfaces 18 and 24 of the first metal deposit 12 and the second metal deposit 14, respectively, fit well together so that the resulting interface 28 (FIG. 1) and the molding cavity 30 are of a very good quality without requiring any "spotting."

In a preferred embodiment, an extremely high quality interface 28 can be achieved by prepping the parting surface 18 of the first metal deposit 12 prior to the spraying of the metal particles 62 to form the second metal deposit 14. The prepping reduces the amount, and intensity, of the mechanical bonding sites between the first and second deposits 12 and 14. One manner of prepping the parting surface 18 of the first metal deposit 12 is to smooth the parting surface 18 by mechanically reducing the number bonding sites on the parting surface 18. This can preferably be done with a bead blaster operated at above 80 psi before the spray forming pattern 32 is positioned on the first metal deposit 12. Preferably, bead blasting should be performed at a pressure below 80 psi if the prepping is to occur after the spray forming pattern 32 is positioned on the first metal deposit 12. This will allow the newly sprayed metal particles 62 to adhere to the first metal deposit 12 in a manner which will allow the deposits 12 and 14 to be easily separable.

Another method of prepping the parting (surface 18 of the first metal deposit 12 to reduce the amount of mechanical bonding sites between the deposits 12 and 14 is to apply a release agent to the parting surface 18 of the first metal deposit 12 prior to the spray forming of the second metal deposit 14. The release agent will inhibit most of the mechanical bonding sites from being effective. A particularly preferred release agent is Weld-R-White, which is a water soluble mixture of boron nitride, clay and water.

While the best modes for carrying out the invention have been described in detail, those familiar with the art to which this invention relates will recognize various alternative designs and embodiments for practicing the invention as defined by the following claims.

What is claimed is:

1. A method of making a molding tool comprising a core die and a cavity die, said method comprising:

(a) providing a first steel deposit comprising one of the cavity die or the core die, the first deposit having a die face;

(b) forming a spray forming pattern, having a first shape, directly on a portion of the die face of the first deposit;

(c) spraying steel particles onto the first deposit and the spray forming pattern to form a second steel deposit comprising the other of the cavity die or the core die; and (d) removing the spray forming pattern from the first and second steel deposits.

2. The method of claim 1, further comprising separating the first deposit from the second deposit.

3. The method of claim 2 wherein the first deposit is separated from the second deposit prior to said step (d) removing the spray forming pattern from the deposits.

4. The method of claim 2 wherein the first deposit is separated from the second deposit after said step (d) removing said spray forming pattern from the deposits.

5. The method of claim 1 wherein the spray forming pattern is made of a metallic material.

6. The method of claim 1 wherein the spray forming pattern is made of a ceramic material.

7. The method of claim 5 wherein said step (d) of removing the spray forming pattern comprises heating the deposits and the pattern to a first temperature which is sufficient to melt the spray forming pattern but is not sufficient to melt the deposits.

8. The method of claim 7 wherein the spray forming pattern material comprises an alloy of tin and bismuth and the first temperature is between about 200° C. and about 500° C.

9. The method of claim 1 wherein the die face of the first metal deposit is coated with a release agent prior to said step (c).

10. The method of claim 9 wherein the release agent comprises boron nitride.

11. The method of claim 1 wherein the die face is mechanically prepped with a bead blaster prior to said step (c).

12. The method of claim 1 wherein said step (b) of forming the spray forming pattern directly on the first deposit comprises providing a casting mold directly on the first deposit, the casting mold having a first cavity having a second shape which is substantially similar to the first shape of the spray forming pattern, pouring liquified spray forming pattern material into the first cavity of the casting mold, and solidifying the liquified spray forming pattern material to form the spray forming pattern directly on the first deposit.

13. The method of claim 12 wherein the forming of the casting mold directly on the first deposit comprises placing the first deposit in an open box, placing a master on the first deposit, the master having a third shape which is substantially similar to the first shape, pouring liquified casting mold material into the box to cover at least the master and a portion of the first deposit, and solidifying the liquified casting mold material to form the casting mold.

14. The method of claim 13 further comprising removing the master from the box after the formation of the casting mold and prior to the pouring of the liquified spray forming pattern material into the cavity of the casting mold.

15. The method of claim 14 wherein at least a pour channel and a vent are formed in the casting mold after the liquified casting mold material is solidified to form the casting mold and prior to pouring the liquified spray forming pattern material into the cavity of the casting mold.

16. The method of claim 15 wherein the casting mold material comprises silicone.

17. The method of claim 12 wherein the casting mold is removed from the first deposit prior to the spraying in step (c).

18. The method of claim 12 wherein the first and second steel deposits are made from carbon steel material having a carbon content in the range of 0.01 to 0.9% by weight.

19. A method of making a molding tool comprising a core die, a cavity die and a first cavity having a first shape, said method comprising:

(a) providing a first deposit comprising one of the cavity die or the core die, the first deposit having a die face;

(b) forming a casting mold directly on the die face of the first deposit, the casting mold having a second cavity, the second cavity having a second shape which is substantially the same as the first shape;

(c) pouring liquified spray forming pattern material into the second cavity of the casting mold and solidifying the liquified spray forming pattern material to form a spray forming pattern directly on the first deposit, the spray forming pattern having a third shape which is substantially the same as the, first shape, the spray forming pattern material being selected from the group consisting of metal and ceramic;

(d) removing the casting mold from the first die;

(e) spraying carbon steel particles, originating from a sprayable carbon steel material in which the carbon content is in the range of 0.01 to 0.9% by weight, onto the first deposit and the spray forming pattern to form a second deposit made of carbon steel, the second deposit comprising the other of the cavity die or the core die; and (f) removing the spray forming pattern from the first and second steel deposits.

20. The method of claim 19 wherein the forming of the casting mold directly on the first deposit comprises placing the first deposit in an open box, placing a master on the first deposit, the master having a fourth shape which is substantially similar to the first shape, pouring liquified casting mold material into the box to cover at least the master and a portion of the first deposit, solidifying the liquified casting mold material to form the casting mold, and removing the master from the box after the formation of the casting mold and prior to the pouring of the liquified spray forming pattern material into the cavity of the casting mold.

* * * * *